US008602461B2

(12) United States Patent
Oliveto

(10) Patent No.: US 8,602,461 B2
(45) Date of Patent: Dec. 10, 2013

(54) KNOT TYING DEVICE AND METHOD

(76) Inventor: Maureen A. Oliveto, Highland Mills, NY (US)

( * ) Notice: Subject to any disclaimer, the term of this patent is extended or adjusted under 35 U.S.C. 154(b) by 0 days.

(21) Appl. No.: 13/214,509

(22) Filed: Aug. 22, 2011

(65) Prior Publication Data

US 2011/0298212 A1 Dec. 8, 2011

Related U.S. Application Data

(62) Division of application No. 12/526,856, filed as application No. PCT/US2008/052147 on Jan. 28, 2008, now Pat. No. 8,002,316.

(51) Int. Cl.
*B65H 69/04* (2006.01)

(52) U.S. Cl.
USPC ..... 289/2

(58) Field of Classification Search
USPC ..... 289/2, 16.5, 17, 18.1
See application file for complete search history.

(56) References Cited

U.S. PATENT DOCUMENTS

| | | | | | |
|---|---|---|---|---|---|
| D112,814 | S | | 1/1939 | Lovgren et al. | |
| 2,360,416 | A | | 10/1944 | Gray | |
| 2,469,037 | A | | 5/1949 | Harvey | |
| 2,624,957 | A | | 1/1953 | Collins | |
| 3,044,670 | A | * | 7/1962 | Barefoot | 223/46 |
| 3,377,674 | A | * | 4/1968 | Brassaw et al. | 28/147 |
| 4,032,179 | A | | 6/1977 | Goss | |
| 4,045,061 | A | | 8/1977 | Fierro | |
| 4,101,152 | A | | 7/1978 | Gardipee | |
| 4,525,003 | A | | 6/1985 | Tate | |
| 4,613,173 | A | | 9/1986 | Rosser | |
| 4,629,100 | A | * | 12/1986 | Owens | 223/46 |
| 4,790,575 | A | | 12/1988 | Tate | |
| 4,864,762 | A | | 9/1989 | Cox | |
| D330,668 | S | | 11/1992 | Nagamatsu | |
| 5,499,759 | A | * | 3/1996 | Richards | 223/46 |
| 5,632,086 | A | | 5/1997 | Helwig | |
| 5,772,171 | A | * | 6/1998 | Masaoka et al. | 248/397 |
| 5,878,788 | A | | 3/1999 | Gurry | |
| 6,000,586 | A | * | 12/1999 | Cavender | 223/46 |
| 6,128,944 | A | * | 10/2000 | Haynes | 72/458 |
| 6,131,778 | A | * | 10/2000 | Etzion | 223/46 |
| 6,171,317 | B1 | | 1/2001 | Jackson et al. | |
| D450,770 | S | | 11/2001 | Starkey | |
| 6,691,903 | B2 | * | 2/2004 | West, Sr. | 223/46 |
| 6,872,079 | B1 | | 3/2005 | Herndon | |
| 2004/0091665 | A1 | | 5/2004 | Suzigan | |
| 2005/0279745 | A1 | | 12/2005 | Gupta | |
| 2007/0068567 | A1 | | 3/2007 | Rubin et al. | |

* cited by examiner

*Primary Examiner* — Shaun R Hurley
(74) *Attorney, Agent, or Firm* — Calhelha & Doyle LLC

(57) ABSTRACT

A device for precisely spacing knots in a string that includes: a generally flat, rectangular board; a centered post projecting outwardly of and generally perpendicular to the board and for enabling tying the free end of the string about the post and enabling forming knots in the string upon tightening of same; and, a plurality of selectable measurement points on the board, aligned longitudinally, transversely of the board and extending outwardly from the post in equi-distantly spaced relation and for enabling positioning a predetermined point along the string at one of the selectable measurement points, the spacing between the string predetermined point and a knot formed at the post being determined by the spacing between the post and the selected measurement point.

6 Claims, 3 Drawing Sheets

KNOT TYING DEVICE AND METHOD

CROSS-REFERENCE TO RELATED APPLICATION

The present application is related to Provisional Application Ser. No. 60/889,974 filed Feb. 15, 2007 and co-pending U.S. patent application Ser. No. 12/526,856 filed on Aug. 12, 2009. These prior applications are incorporated herein by this reference and the benefit of the earliest filing date is claimed herein as well.

BACKGROUND OF THE INVENTION

1. Field of the Invention

This invention relates to making jewelry such as necklaces, bracelets and the like and, in particular, to a knot tying device and method useful in the making of jewelry.

2. Description of the Prior Art

In making jewelry such as necklaces, bracelets and anklets, frequently beads are spaced at predetermined intervals along a string, with the string being knotted on both sides of the bead to provide and maintain bead spacing. In most instances the spacing is at equal intervals.

However, in the past, the spacing of the beads along the string has been completely manual, without the use of any tools and somewhat inaccurate at best.

For example, first a knot is placed in the string, then a bead is positioned next to the knot and glued, possibly, followed by another knot. A distance to the next knot is chosen, by laying down a string on a guide, pinching the string with one hand where the next knot is wanted, trade the pinch with the other hand, pinch again, loop the string at the pinch point and tighten to form the second knot.

The process is tedious, not completely accurate, hand intensive, and represents a major portion of the labor time in the making of the jewelry.

It is towards the solution of this problem that the present invention is directed.

SUMMARY

An object of the invention is to reduce the time and difficulty in making jewelry involving the placement and spacing of beads along a string.

Another object is the making of jewelry that involves the placement and spacing of beads along a string where only one device is required. These and other objects, features and advantages are accomplished in accordance with the teachings of the present invention, one illustrative embodiment of which comprises a device for precisely spacing knots in a string that includes: a generally flat, rectangular board; a centered post projecting outwardly of and generally perpendicular to the board and for enabling tying the free end of the string about the post and enabling forming knots in the string upon tightening of same; and, a plurality of selectable measurement points on the board, aligned longitudinally, transversely of the board and extending outwardly from the post in equi-distantly spaced relation and for enabling positioning a predetermined point along the string at one of the selectable measurement points, the spacing between the string predetermined point and a knot formed at the post being determined by the spacing between the post and the selected measurement point.

In use, a pre-determined point along the string is placed on the board at one of the selectable measurement points. The free end of the string is tied about the post. The free end of the string is pulled tightly to form a knot at the post. The spacing between the string predetermined point and the knot formed at the post is determined by the spacing between the post and the selected measurement point. The method is used in forming jewelry by interspersing beads between knots whose positions have been pre-selected, using the device and technique previously set forth.

BRIEF DESCRIPTION OF THE DRAWINGS

Other objects, features and advantages of the present invention will be apparent from the following detailed description and accompany drawing, wherein.

DETAILED DESCRIPTION

Figure 1:
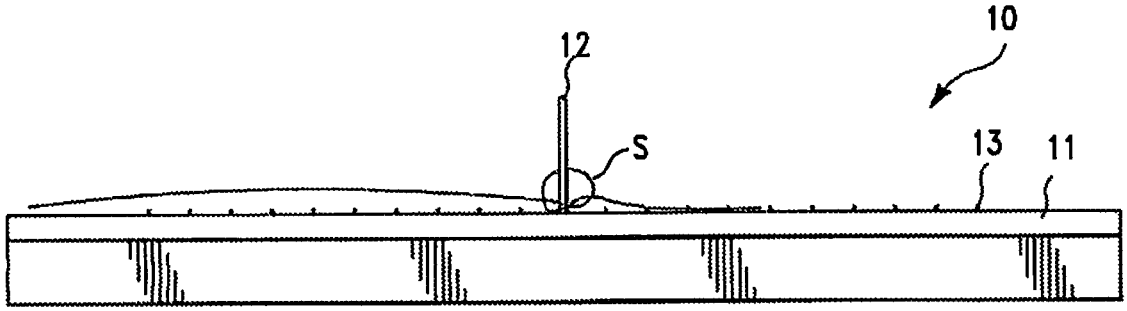
FIG. 1 is a side view of the device of the present invention.

Referring now to the drawing, the device 10 is seen as including a generally flat board 11, with a post 12 projecting outwardly and generally perpendicular to the board. The post enables forming knots in a string at the post upon tightening of same. The string may be of wax line, silk cord, yarn, thin leather and the like.

A plurality of selectable measurement points 13 is placed on the board, extending outwardly from the post 12.

The board 11 is made of some type of hardwood, generally rectangular in shape, say, six inches across by four inches wide, although other materials may be used. A felt matting (not shown) may be placed on the bottom to protect the surface on which the user is working.

The post 12 is centrally positioned and perpendicular to the board 11, made of metal and extends approximately one inch in length above the board. Some form of protective cover can be placed over the post when the device 10 is not in use.

The measurements 13 typically are aligned on either side of the post (one side for a right handed user, the other for a left handed user) and spaced at fixed intervals, usually equal, outwardly of the post, say every one quarter inch. One would want to have measurements at the intervals where knots for the beads would be positioned.

The device 10 is intended for making jewelry such as necklaces and bracelets where one would want to be spacing beads B at predetermined intervals along the jewelry's string S.

Starting at a pre-selected point along the string, the string may be tied around the post (FIG. 1A) and tightened by pulling on the free end to form a knot K. The knot is lifted off the post. A first bead is then placed on the string next to this first knot. The string is then tied around the post, tightened by pulling on the free end of the string to form a second knot, but on the opposite side of the bead. The knot is lifted off the post.

Figure 1A:
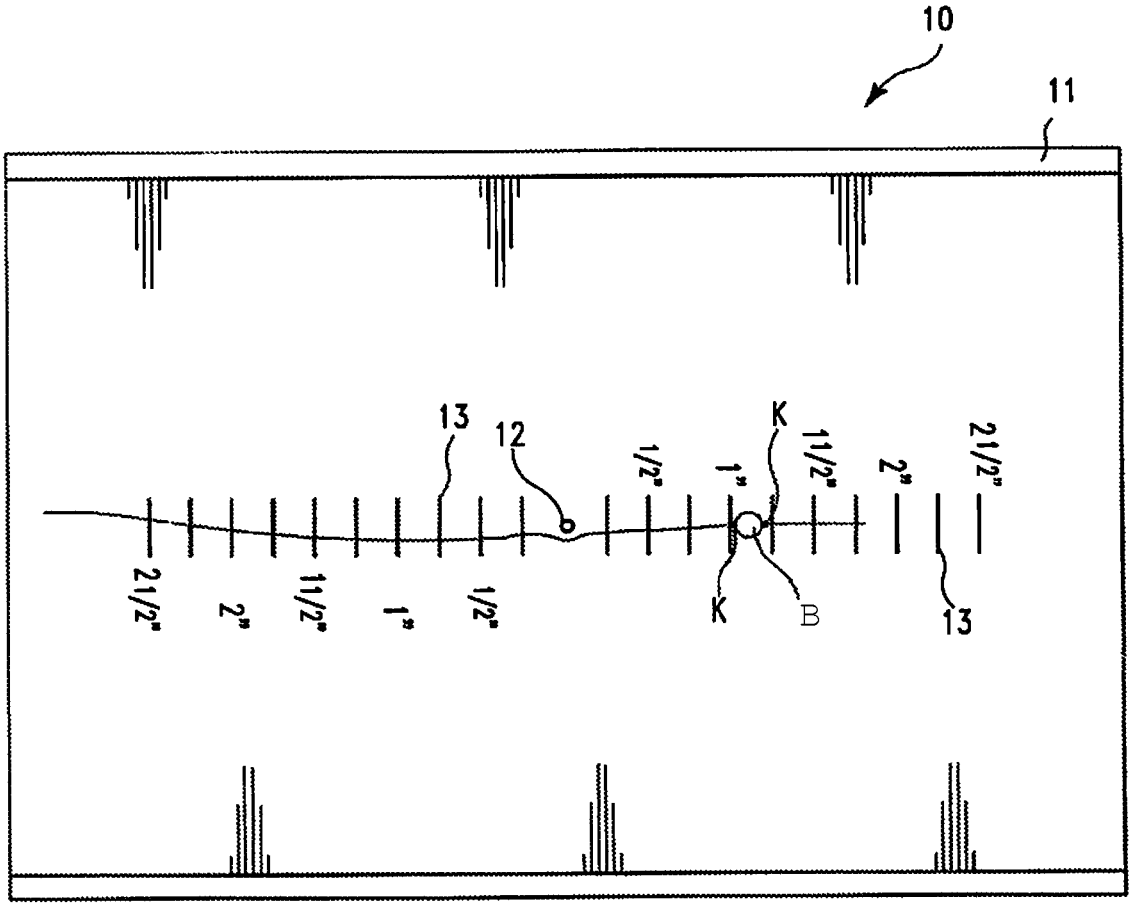
FIG. 1A is a top view of the device of FIG. 1.

The first bead is then placed on the board at one of the selectable measurement points. The measurement point selected is determined by the user and is dependent on the spacing desired between adjacent beads. So, for example, a knot adjacent the first bead may be placed at the one inch measurement because the user wants one inch spacing between the beads (FIG. 1B).

Figure 2:
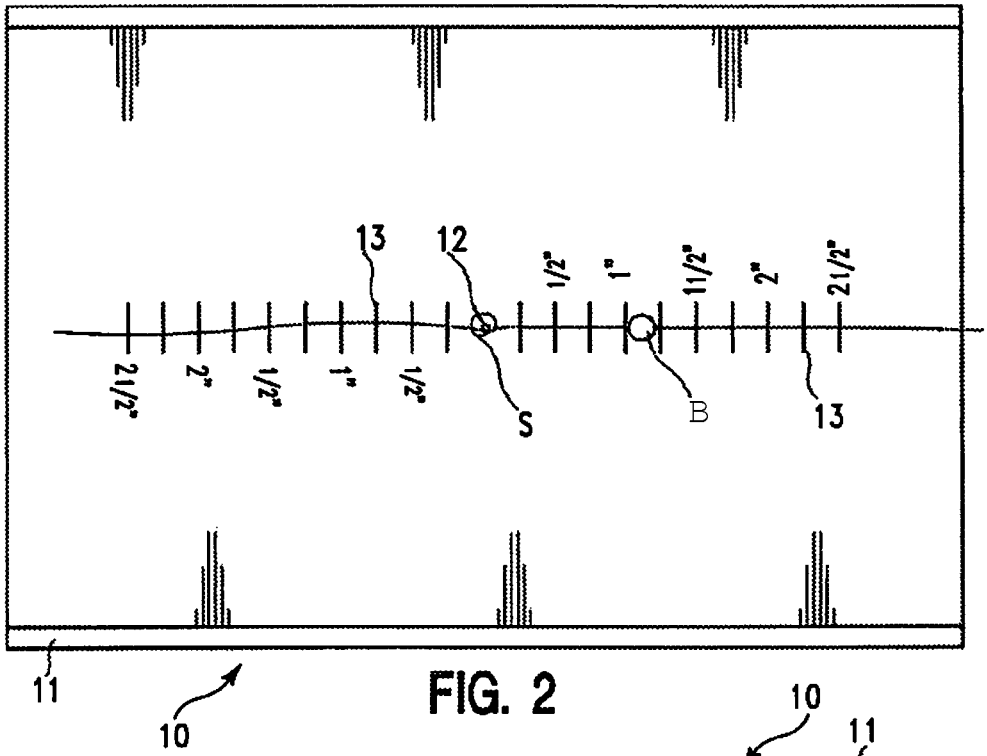
FIGS. 2-4 are successive top views of the device showing beaded jewelry being formed according to the method of the present invention.
Figure 3:
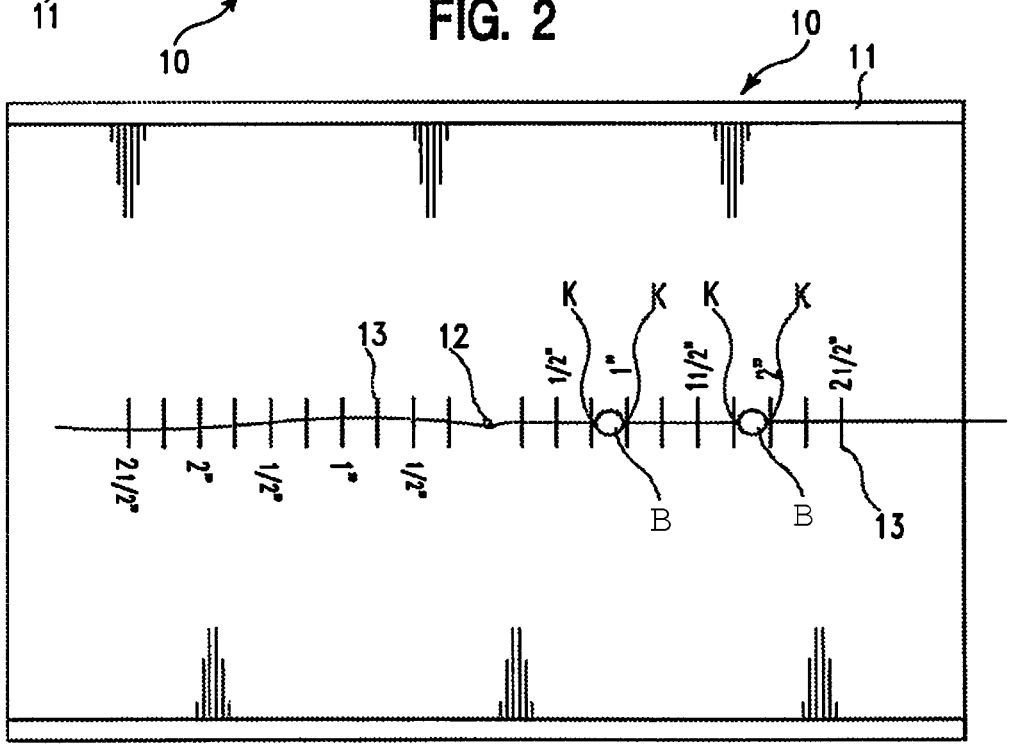
Figure 4:
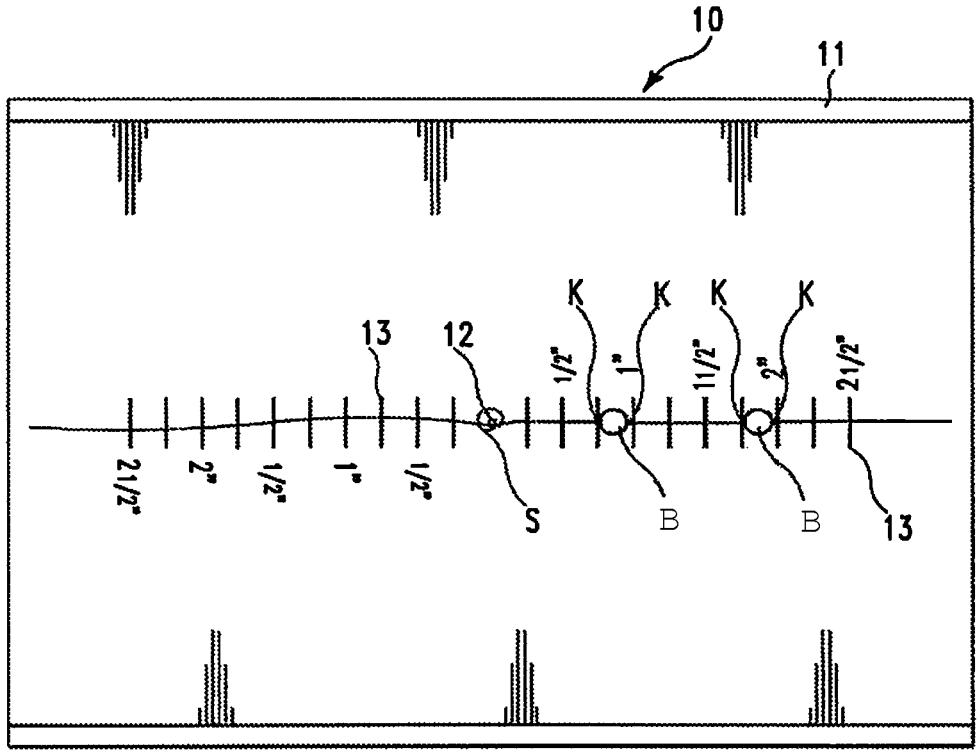

With this first bead in place at the selected measurement point, being held there by the user, the free end of the string is then tied around the post (FIG. 2) and tightened to form a third knot. This third knot is then lifted off the post, followed by a repetition in the process where a second bead is placed on the string, a fourth knot is formed on the string on the opposite side of the second bead, the knot for the second bead is placed at a selected measurement point (FIG. 3) and the free end of the string is again tied around the post (FIG. 4) and tightened to form a fifth knot and so forth.

This process continues until the user has placed all the beads on the string at the desired positions to form the necklace or bracelet.

Previous methods of placing the beads on the string were time consuming, thus raising the cost of manufacture of same and it was difficult to precisely locate the knots.

It should be obvious that changes, additions and omissions may be made in the details and arrangement of parts without departing from the spirit and scope of the invention as hereinafter claimed.

The invention claimed is:

1. A device for precisely spacing knots in a string, comprising:

a generally flat board;

a single centrally positioned post projecting outwardly of and generally perpendicular to the board and for enabling tying the free end of the string about the post and enabling forming, interspersing and spacing knots in the string upon tightening of same; and, a plurality of selectable measurement points on the board, extending outwardly from the post in spaced relation and for enabling precise positioning at a predetermined point along the string at one of the selectable measurement points, the spacing between the string predetermined point and a knot formed at the post being determined by the spacing between the post and the selected measurement point wherein the board is rectangular and the single post is centered on the board.

2. The device of claim 1 wherein the selectable measurement points are aligned longitudinally of the post and transversely of the board.

3. The device of claim 1 wherein the selectable measurement points are equi-distantly spaced.

4. A device for precisely spacing knots in a string, consisting essentially of:

a generally flat board;

a single post projecting outwardly of and generally perpendicular to the board and for enabling tying the free end of the string about the post and enabling forming, interspersing and spacing knots in the string upon tightening of same; and, a plurality of selectable measurement points on the board, extending outwardly from the post in spaced relation and for enabling precise positioning at a predetermined point along the string at one of the selectable measurement points, the spacing between the string predetermined point and a knot formed at the post being determined by the spacing between the post and the selected measurement point wherein the board is rectangular and the single post is centered on the board.

5. The device of claim 4 wherein the selectable measurement points are aligned longitudinally of the post and transversely of the board.

6. The device of claim 4 wherein the selectable measurement points are equi-distantly spaced.

* * * * *